US008360338B2

(12) United States Patent
Gunji et al.

(10) Patent No.: US 8,360,338 B2
(45) Date of Patent: Jan. 29, 2013

(54) FUEL INJECTION VALVE AND MACHINING METHOD FOR NOZZLE

(75) Inventors: Kenichi Gunji, Mito (JP); Masato Higuma, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 266 days.

(21) Appl. No.: 12/918,045

(22) PCT Filed: Jun. 26, 2009

(86) PCT No.: PCT/JP2009/062169

§ 371 (c)(1),
(2), (4) Date: Aug. 17, 2010

(87) PCT Pub. No.: WO2010/026829

PCT Pub. Date: Mar. 11, 2010

(65) Prior Publication Data

US 2011/0011954 A1 Jan. 20, 2011

(30) Foreign Application Priority Data

Sep. 5, 2008 (JP) ..... 2008-227722

(51) Int. Cl.
*F02D 1/06* (2006.01)

(52) U.S. Cl. ..... 239/5; 239/533.12; 239/585.1; 239/585.5; 29/890.143

(58) Field of Classification Search ..... 239/5, 533.11, 239/533.12, 585.1, 585.4, 585.5; 29/890.142, 29/890.143

See application file for complete search history.

(56) References Cited

U.S. PATENT DOCUMENTS

2006/0191511 A1* 8/2006 Mifuji et al. ..... 239/533.12
2007/0057093 A1* 3/2007 Gunji et al. ..... 239/533.12

FOREIGN PATENT DOCUMENTS

| | | | |
|---|---|---|---|
| JP | 3355190 | B2 | 10/1997 |
| JP | 10-159688 | A | 6/1998 |
| JP | 2006-272484 | A | 10/2006 |
| JP | 2008-101499 | A | 5/2008 |
| JP | 2008-184977 | A | 8/2008 |
| WO | WO 95/24286 | A1 | 9/1995 |

OTHER PUBLICATIONS

International Search Report dated Aug. 11, 2009 with English translation (Five (5) pages).

* cited by examiner

*Primary Examiner* — Steven J Ganey
(74) *Attorney, Agent, or Firm* — Crowell & Moring LLP

(57) ABSTRACT

A fuel injection valve with reduced adhesion of deposits to a fuel injecting portion and superior in durability is provided. Also provided is a method for machining multi-orifice type fuel injecting portions easily, less expensively, in good surface roughness, in high productivity, and with few variations in shape, accuracy and surface roughness, using inexpensive equipment. The surface roughness of fuel injecting portions comprising orifices and apertures is made Rz 2 μm or less. Apertures are formed by press working so as to each have a plastic-worked surface of Rz 0.2 μm or less in surface roughness and then orifices are formed in the bottoms of the apertures so as to have a plastic-worked surface of Rz 0.2 μm or less in surface roughness. Further, when abrasion resistance of the nozzle is required, the fuel injecting portions are finished to a surface roughness of Rz 2 μm by quenching.

4 Claims, 11 Drawing Sheets

FUEL INJECTION VALVE AND MACHINING METHOD FOR NOZZLE

TECHNICAL FIELD

The present invention relates to a fluid injecting portion and more particularly to surface roughness and a machining method for a fuel injecting portion in a fuel injection valve effective for a direct injection internal combustion engine.

BACKGROUND ART

A fuel injection valve in a direct injection internal combustion engine is exposed to combustion gas of a high temperature because it is installed in the interior of the engine. Therefore, for example carbon resulting from fuel combustion is apt to be deposited at a tip portion of the fuel injection valve. Foreign matters such as oil, additives and water are mixed in fuel and are deposited in the fuel injecting portion during operation of the engine. Such deposited foreign matters are called deposits. Once deposits are formed in the fuel injecting portion, there arises the problem that highly accurate fuel injection can no longer be effected no matter high accurately the fuel injection valve may be constructed.

Particularly, in the case of a fuel injection valve having plural orifices, the deposits become more influential because the orifices are small.

In view of this point, for example in Japanese Patent Laid Open No. Hei 10 (1998)-159688 (Patent Document 1), a volatile film is formed on an orifice surface with a surface roughness of Rz 1 micron or less to improve the deposits suppressing effect.

On the other hand, as a method for machining a plurality of deflected orifices in a nozzle there is known an electric discharge machining method which is disclosed in Japanese Patent Laid Open No. 2006-272484 (Patent Document 2). According to the machining method for deflected fine holes (orifices) which method is disclosed in Patent Document 2, prepared holes are formed in a workpiece beforehand by laser beam machining and are established their positions by image processing, thereafter, fine holes are formed by electric discharge machining.

PRIOR TECHNICAL DOCUMENTS

Patent Document 1: Japanese Patent Laid Open No. Hei 10-159688

Patent Document 2: Japanese Patent Laid Open No. 2006-272484

DISCLOSURE OF THE INVENTION

Problems to be Solved by the Invention

In Japanese Patent Laid Open No. Hei 10-159688, since orifices are formed by drilling, surface roughness is bad and is adjusted to Rz 1 μm or less by polishing. However, there still occur deposits and a percentage flow rate lowering becomes 10% or more, so a liquid repelling treatment is performed. However, in the prior art in question, no consideration is given to forming a recess (also called an aperture) in a nozzle tip face and making an orifice outlet open in the recess, nor is given any consideration to surface roughness of this recess.

Surface roughness is improved by polishing, but the shape and diameter of each orifice change as a result of polishing and thus the control of such orifice shape and diameter is difficult.

The present invention has been accomplished for solving the above-mentioned problems and it is an object of the invention to reduce the surface roughness of not only orifices but also apertures formed on orifice injection side and thereby prevent the adhesion of deposits without performing a liquid repelling treatment.

It is another object of the present invention to provide a method able to form, by press working, orifices and apertures with reduced surface roughness and thereby form a large number of deflected orifices easily, less expensively, in high productivity, with few variations in shape, accuracy and surface roughness even in a fuel injecting portion of a complicated shape, and without the need of polishing.

Means for Solving the Problems

In the present invention, for achieving the above-mentioned object, in fuel injecting portions comprising orifices and apertures connected to outlet sides of the orifices, inner surfaces of the fuel injecting portions are all adjusted to Rz 2 μm in surface roughness. More specifically, all of orifices' inner surfaces and apertures' inner surfaces are adjusted to Rz 2 μm or less in surface roughness.

Moreover, apertures are formed by press working so as to have plastic-worked inner surfaces of Rz 0.2 μm or less in surface roughness and then bottom surfaces of the apertures are machined by press working into plastic-worked faces so as to have an orifice surface roughness of Rz 0.2 μm or less. Further, when the nozzle is required to have abrasion resistance, the nozzle is subjected to quenching to finish the inner surface of each fuel injecting portion to a surface roughness of Rz 2 μm or less.

Effect of the Invention

According to the present invention, even in the case of a fuel injection valve having plural orifices in a direct injection internal combustion engine, the adhesion of deposits can be diminished and the fuel injection valve can be improved in durability by adjusting the orifices and apertures to Rz 2 μm or less in surface roughness.

Besides, since orifices and apertures can be formed with reduced surface roughness by press working, the machining can be done easily, less expensively, in high productivity and with few variations in shape, accuracy and surface roughness, using inexpensive equipment.

EMBODIMENTS FOR CARRYING OUT THE INVENTION

Figure 1:
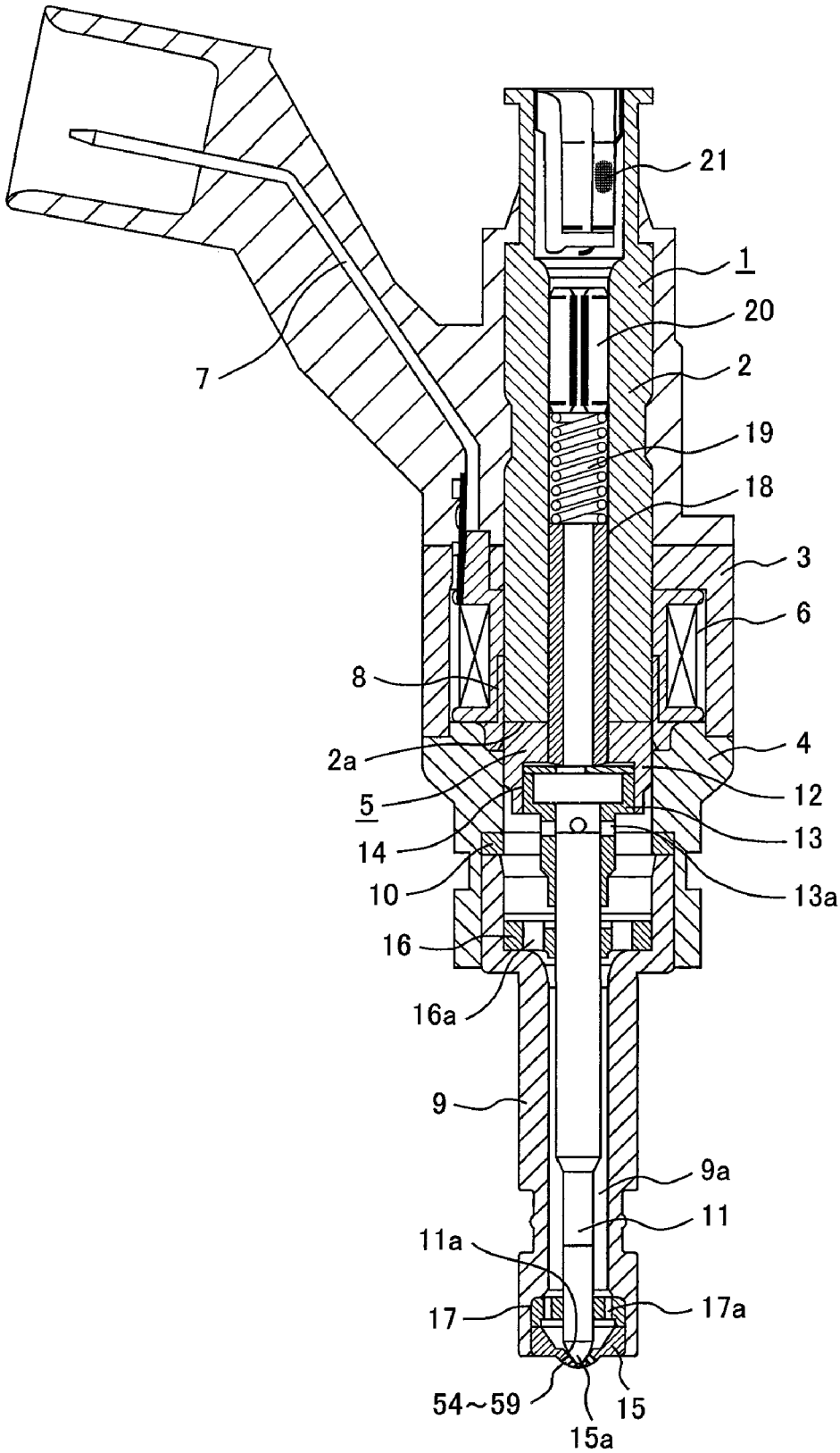
FIG. 1 is a longitudinal sectional view showing an entire configuration of an injection valve according to an embodiment of the present invention.

An embodiment of the present invention will be described below in detail. FIG. 1 is a longitudinal sectional view showing an entire configuration of an injection valve according to an embodiment of the present invention. The injection valve of this embodiment is a fuel injection valve for injecting fuel such as, for example, gasoline and is used for injecting fuel to an automobile engine.

An injection valve body 1 is composed of a magnetic circuit, the magnetic circuit comprising a core 2, a yoke 3, a housing 4 and a movable member 5, a coil 6 for energizing the magnetic circuit, and a terminal portion 7 for energizing the coil 6. A seal ring 8 is coupled between the core 2 and the housing 4 to prevent fluid such as fuel or the like from flowing into the coil 6.

Valve parts, including the movable member 5, a nozzle holder 9 and a ring 10 for adjusting the stroke quantity of the movable member 5, are housed in the interior of the housing 4. The movable member 5 comprises a valve element 11 and a movable core 12 coupled together using a joint 13. Between the movable core 12 and the joint 13 is disposed a plate 14 which conjointly with a pipe 18 suppresses bounding when the movable member 5 moves to close the valve.

The housing 4 and the nozzle holder 9, which constitute a shell member, cover the circumference of the movable member 5. In the nozzle holder 9 are provided an orifice plate 15, the orifice plate 15 having at the tip thereof a seat surface 15*a* (valve seat) and orifices 54 to 59, and a guide plate B17 which together with a guide plate A16 guides the movable member 5 slidably. The orifice plate 15 and the guide plate B17 may be constructed separately or integrally with respect to the nozzle holder 9. The orifices 54 to 59 are each formed with an inlet-side aperture downstream of a seat portion of the seat surface 15*a* (valve seat) which seat portion is in contact with the valve element 11.

In the interior of the core 2 are disposed a spring 19 for urging the valve element 11 to the seat surface 15*a* via the pipe 18 and the plate 14, an adjuster 20 for adjusting an urging load on the spring 19, and a filter 21 for preventing the entry of contamination from the exterior.

Now, a detailed description will be given below about the operation of the injection valve body 1 described above.

When the coil 6 is energized, the movable member 5 is attracted toward the core 2 against the urging force of the spring 19 and a gap is formed (valve open condition) between a valve seat portion 11*a* and the seat surface 15*a* which are located at the tip of the movable member 5. Pressurized fuel first flows from the core 2, adjuster 20 and pipe 18 into the nozzle holder 9 through a fuel passage 13*a* formed within the movable member 5. Next, the fuel flows from a fuel passage 16*a* formed in the guide plate A16 and a passage 9*a* formed in the nozzle holder into a passage 17*a* formed in the guide plate B17, then flows through the gap between the valve seat portion 11*a* and the seat surface 15*a*, further through the orifices 54 to 59 and is injected. The orifices 54 to 59 are formed at different angles in deflected directions relative to the axis of the injection valve.

On the other hand, upon de-energization of the coil 6, the valve seat portion 11*a* of the movable member 5 comes into abutment against the seat surface 15*a* by virtue of the spring 19 and the valve assumes a closed condition.

Next, a detailed description will be given below about the constructions of the orifice plate 15 and orifices 54 to 59 in the injection valve body 1.

Figure 2:
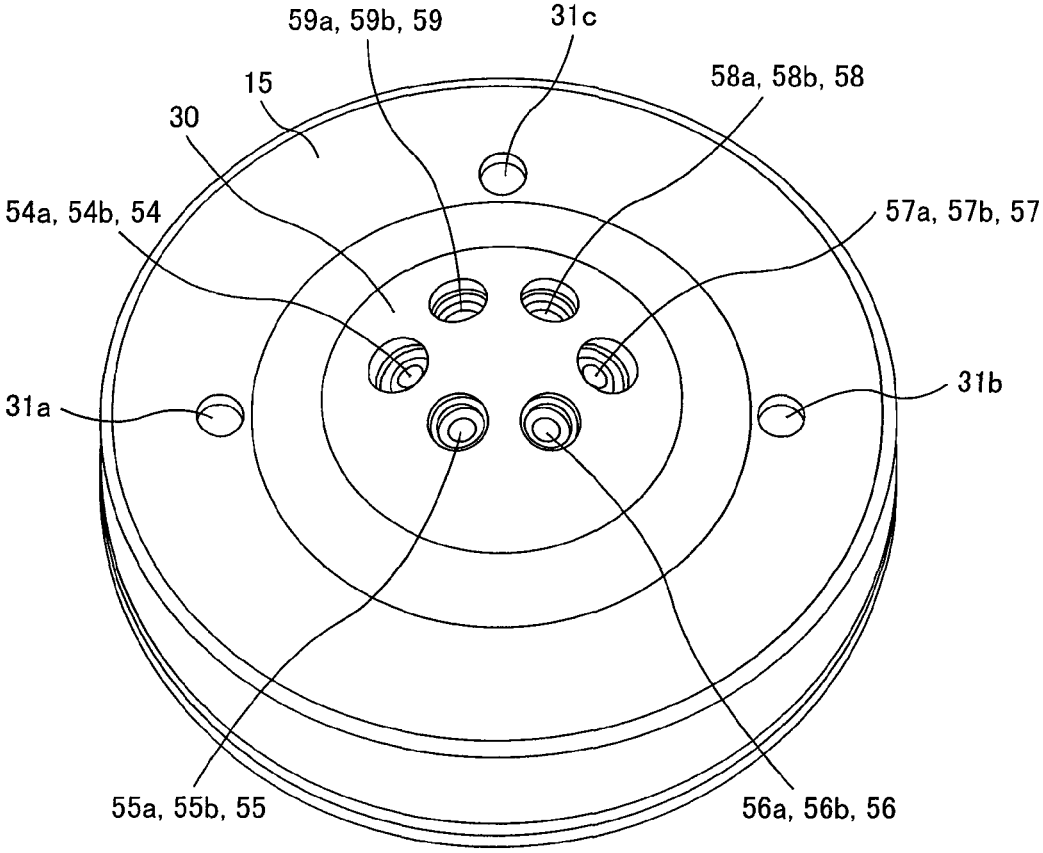
FIG. 2 is a perspective view of an orifice plate according to the embodiment.
Figure 3:
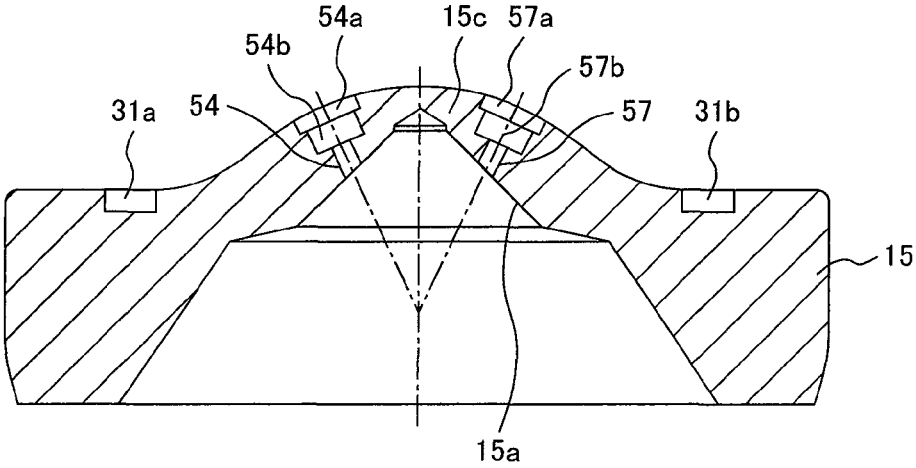
FIG. 3 is a vertical sectional view thereof.

FIGS. 2 and 3 illustrate the embodiment of the invention, of which FIG. 2 is a perspective view of the orifice plate 15 and FIG. 3 is a vertical sectional view thereof.

The orifice plate 15 is a generally disc-like metallic plate. A spherical portion 30 as a curved convex portion is integrally formed at an approximately central part of one end face of the orifice plate 15 and a generally conical seat surface 15*a* having a stepped portion which constitutes a valve seat is formed at an end face of the orifice plate 15 on the side opposite to the spherical portion 30. In the spherical portion 30, orifices 54, 55, 56, 57, 58 and 59 for fuel injection are formed in angled directions relative to the nozzle axis, namely, at different angles in deflected directions, the orifices being arranged in predetermined directions relative to positioning holes 31*a*, 31*b* and 31*c*. On the side opening to the spherical portion 30, which side is a downstream side of the orifices 54 to 59, there are formed generally circular apertures A (54*a*, 55*a*, 56*a*, 57*a*, 58*a* and 59*a*) each defining a stepped portion, while on the side connected to the orifices, which side is an upstream side of the orifices, there are formed generally circular apertures B (54*b*, 55*b*, 56*b*, 57*b*, 58*b* and 59*b*) smaller in diameter than the apertures A, the apertures B being formed in bottoms of the apertures A. Thus, the apertures are each in the form of a recess having two stepped portions as a whole. Bottom faces of the apertures A and B are formed so as to be approximately orthogonal respectively to the axes of the orifices. The axes of each pair of apertures A, B and the axis of the associated orifice are substantially aligned with each other. The depth of each aperture A is smaller than the length of each orifice and smaller than the depth of each aperture B.

The orifice length is highly sensitive to the length of penetration, so by changing the depth of the aperture B 54*b* appropriately it is possible to optimize the length of the orifice 54 in consideration of spray shape and machinability. This is also true of the other orifices. By changing the depth of each aperture B it is possible to change the orifice length and it becomes possible to optimize the spray shape and improve the machinability. Therefore, at least two of the apertures B are different in depth orifice by orifice.

Among the above components, the apertures A and B serve as fuel injecting portions and the respective inner surfaces are quenched plastic-worked surfaces with a surface roughness of Rz 2 μm or less.

Next, a method for machining the orifice plate 15 and the surface roughness of each fuel injecting portion will be described below with reference to FIGS. 4 to 19.

Figure 4:
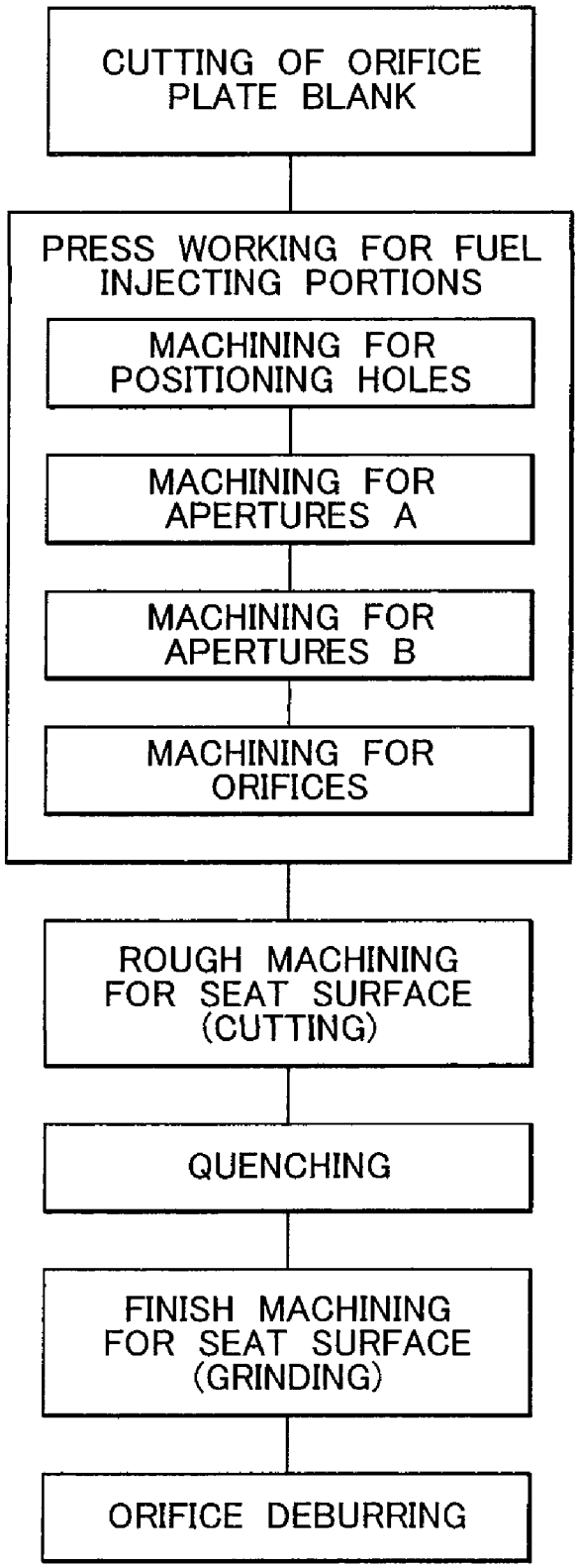
FIG. 4 is a flow chart for machining the orifice plate according to the embodiment.
Figure 5:
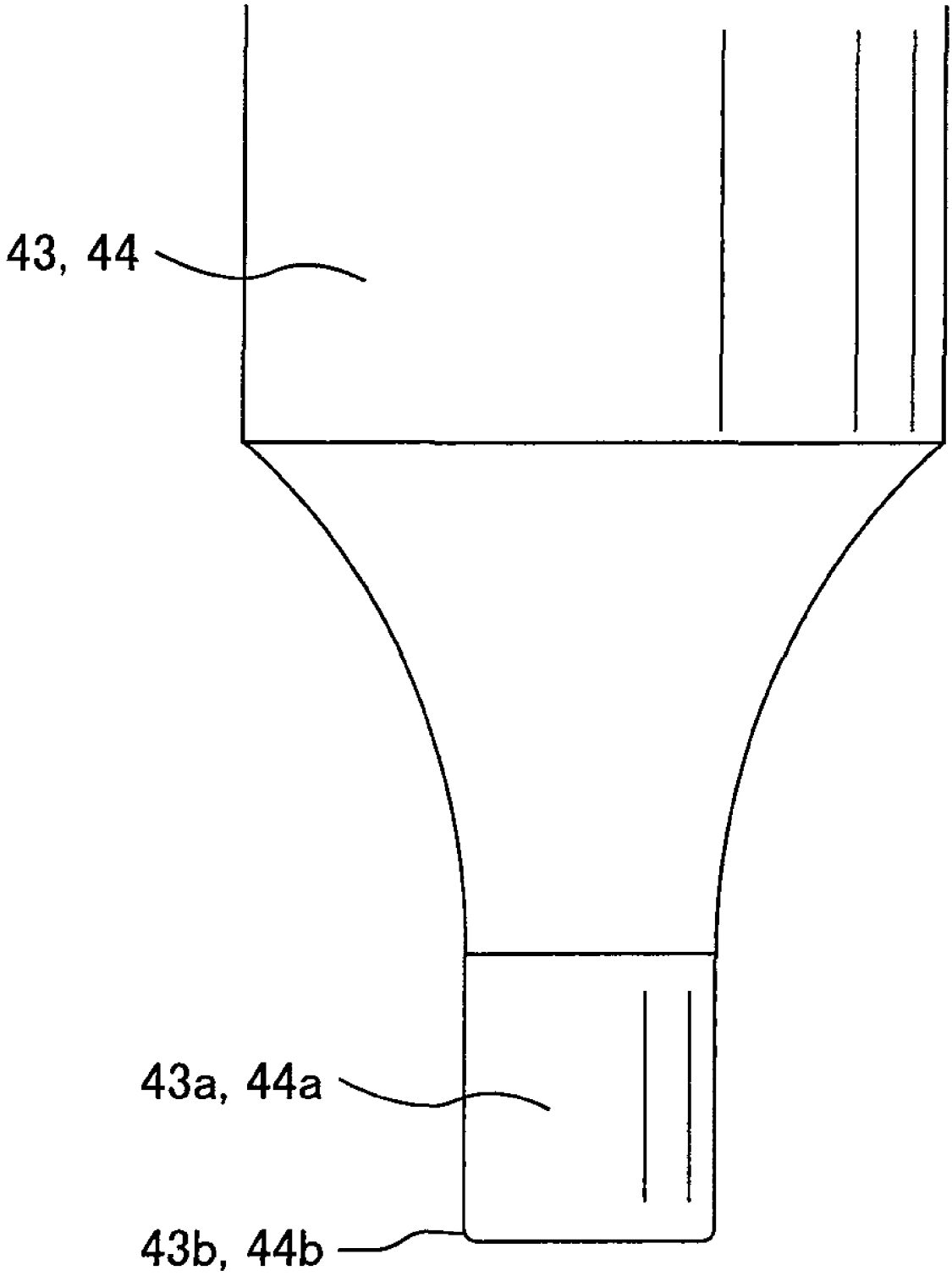
FIG. 5 is an elevational diagram of aperture machining punches according to the embodiment.
Figure 6:
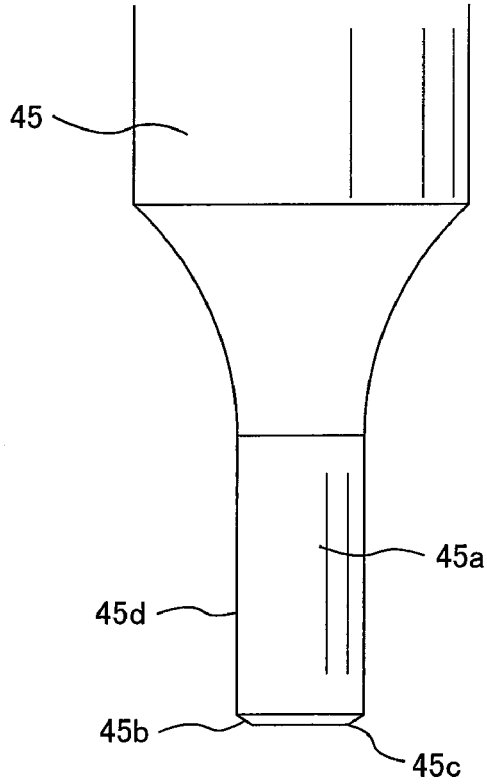
FIG. 6 is an elevational diagram of an orifice machining punch according to the embodiment.
Figure 7:
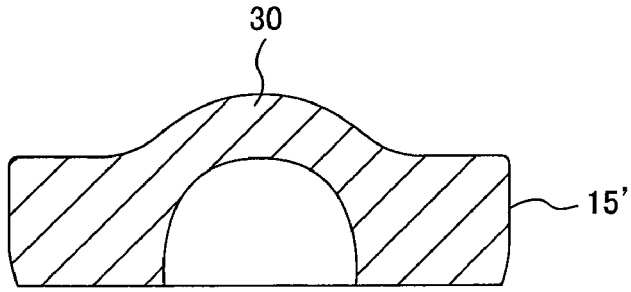
FIG. 7 is a vertical sectional view of an orifice plate blank according to the embodiment.
Figure 8:
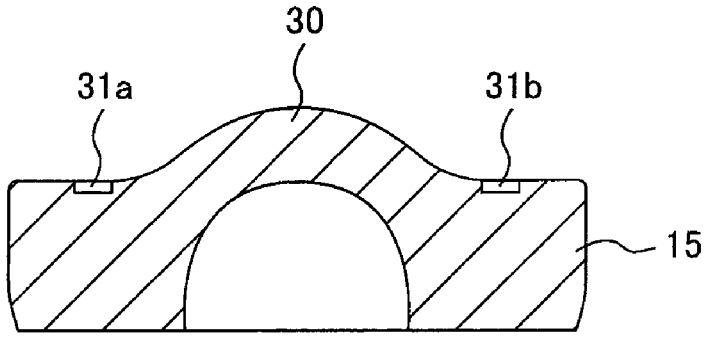
FIG. 8 is a vertical sectional view after machining for positioning holes according to the embodiment.
Figure 9:
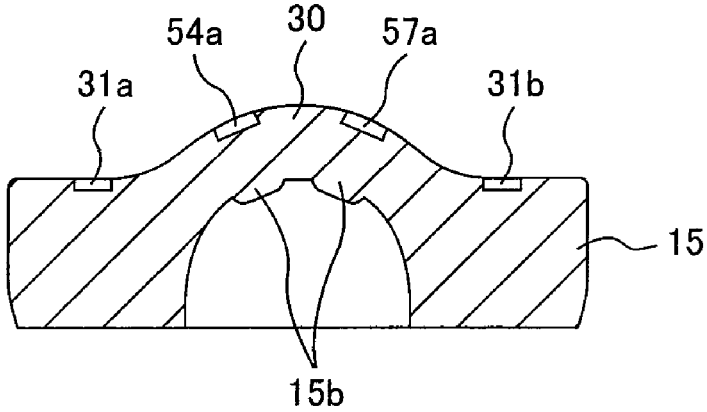
FIG. 9 is a vertical sectional view after machining for apertures A according to the embodiment.
Figure 10:
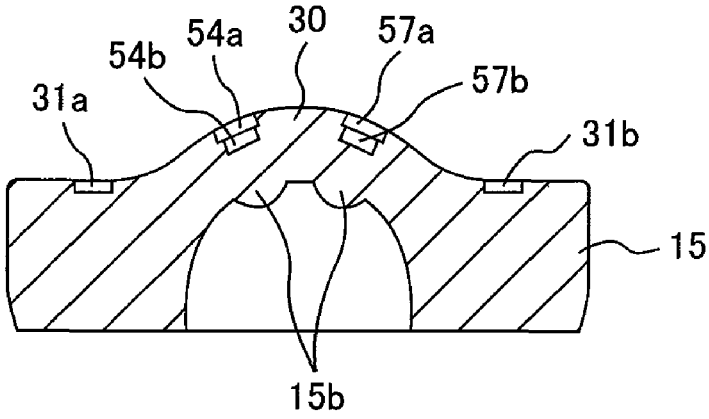
FIG. 10 is a vertical sectional view after machining for apertures B according to the embodiment.
Figure 11:
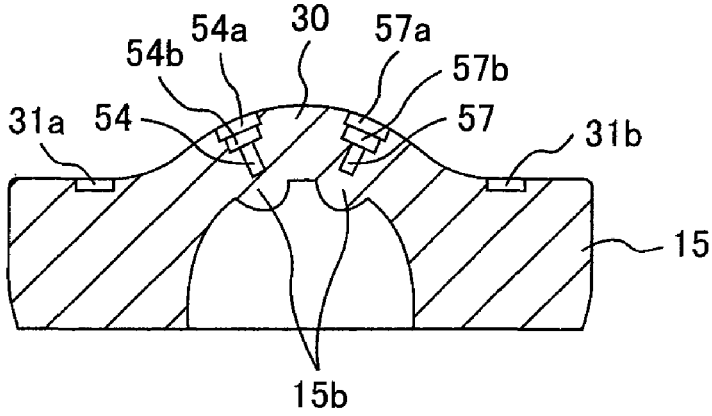
FIG. 11 is a vertical sectional view after machining for orifices according to the embodiment.
Figure 12:
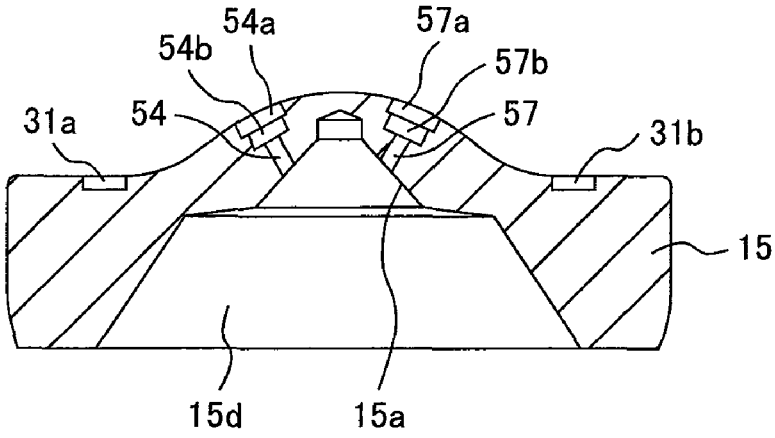
FIG. 12 is a vertical sectional view after rough machining for a seat surface according to the embodiment.
Figure 13:
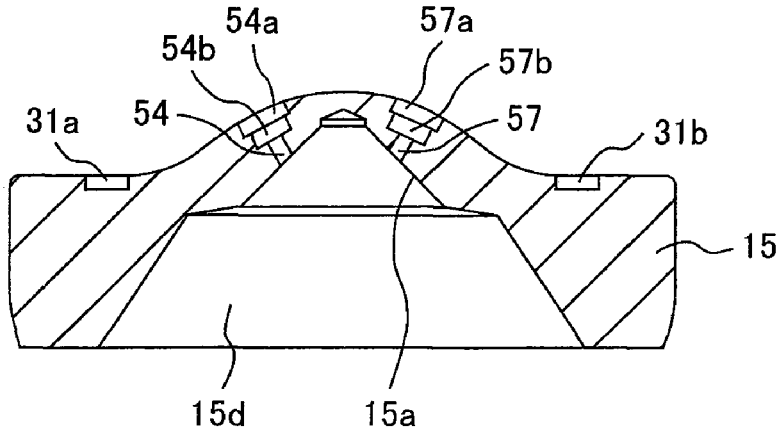
FIG. 13 is a vertical sectional view after finish machining for the seat surface according to the embodiment.
Figure 14:
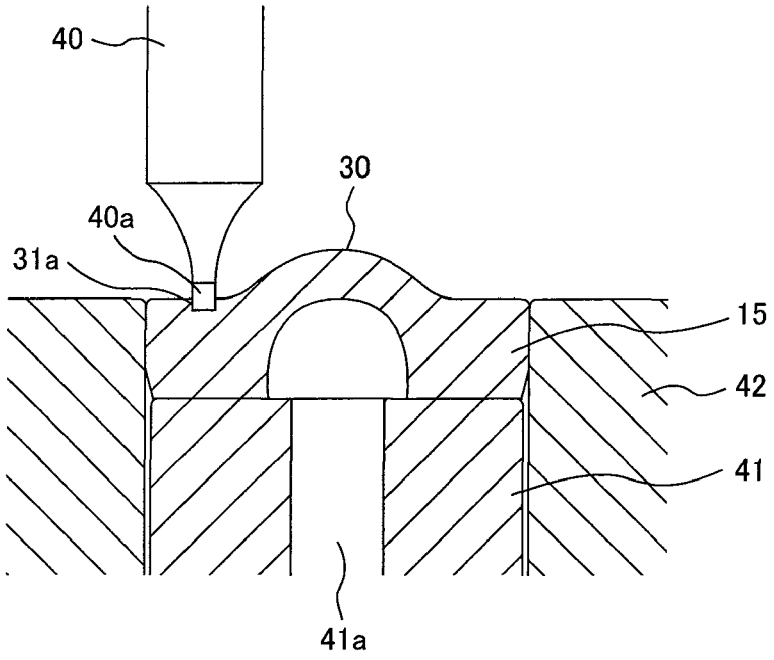
FIG. 14 is a vertical sectional view showing press working for a positioning hole according to the embodiment.
Figure 15:
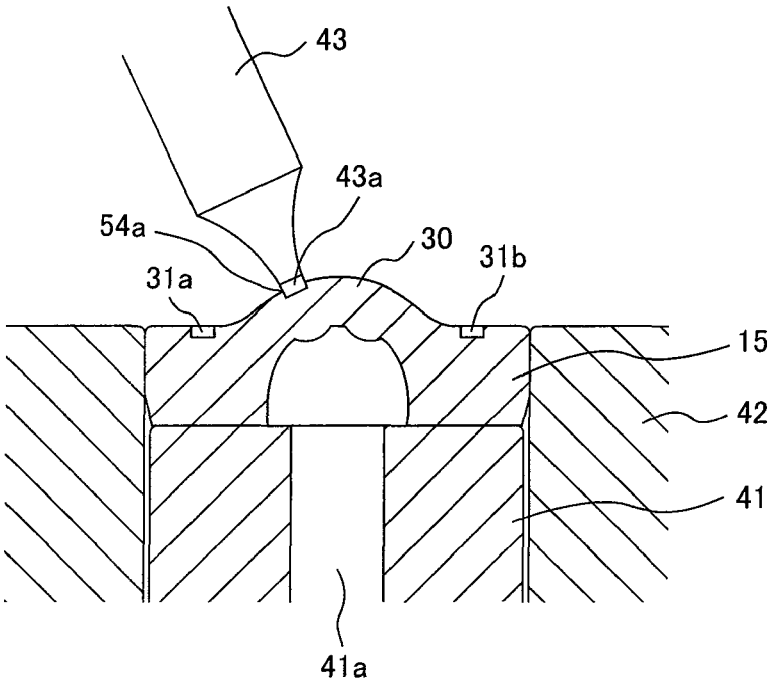
FIG. 15 is a vertical sectional view showing press working for an aperture A according to the embodiment.
Figure 16:
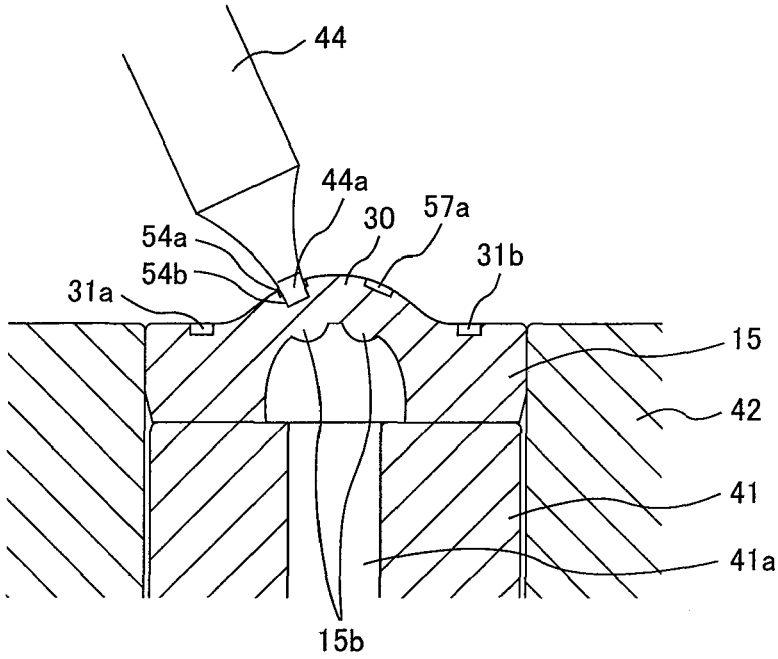
FIG. 16 is a vertical sectional view showing press working for an aperture B according to the embodiment.
Figure 17:
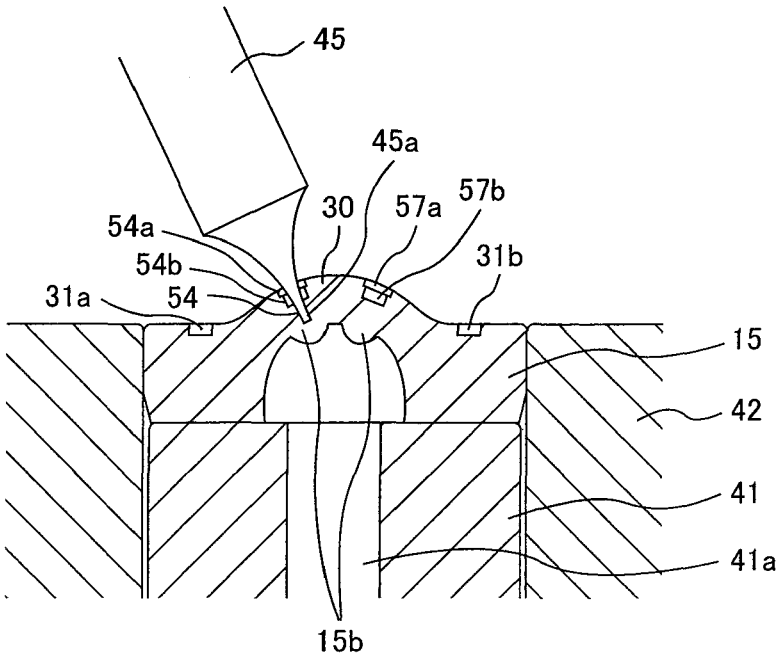
FIG. 17 is a vertical sectional view sowing press working for an orifice according to the embodiment.
Figure 18:
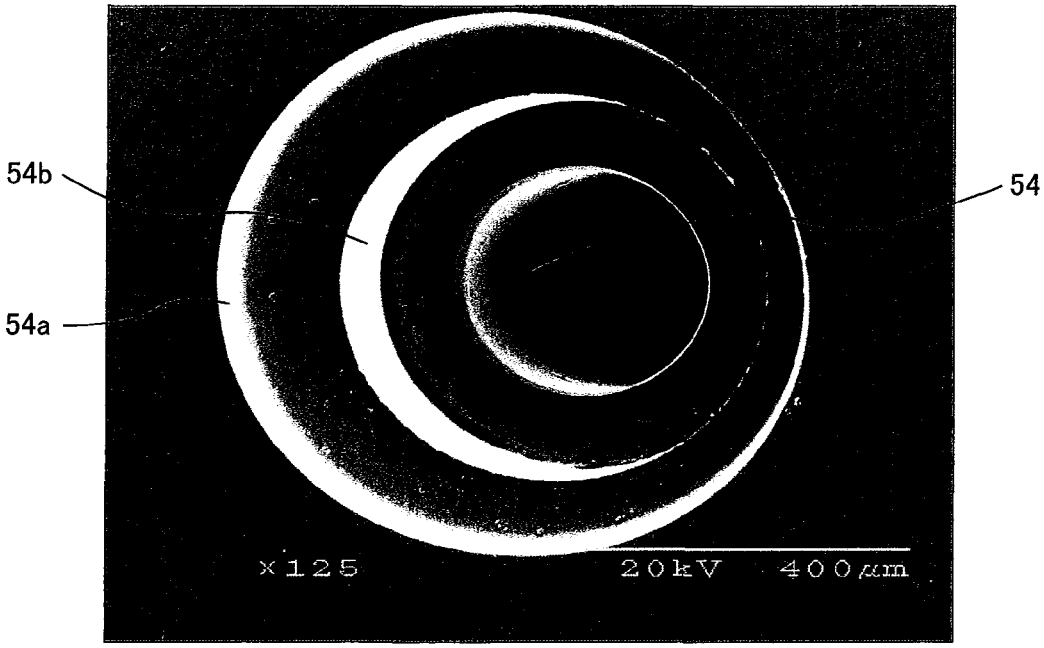
FIG. 18 is a SEM photograph showing a surface condition after press working of apertures A, B and orifice according to the embodiment.
Figure 19:
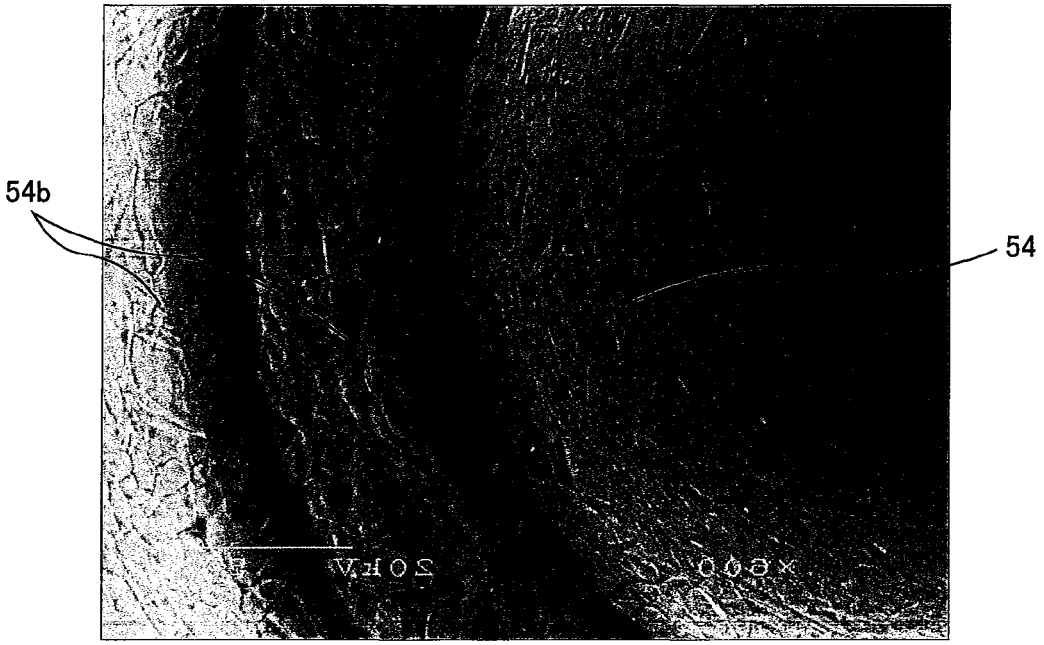
FIG. 19 is a SEM photograph showing a surface condition of apertures B and orifice after quenching according to the embodiment.

FIG. 4 is a flow chart showing a series of machining steps for the orifice plate 15. FIG. 5 is an elevational diagram of aperture machining punches. FIG. 6 is an elevational diagram of an orifice machining punch. FIG. 7 is a vertical sectional view of a blank 15'. FIG. 8 is a vertical sectional view of an orifice plate formed with positioning holes. FIG. 9 is a vertical sectional view of the orifice plate formed with apertures A. FIG. 10 is a vertical sectional view of the orifice plate formed with apertures A and B. FIG. 11 is a vertical sectional view formed with apertures A, B and orifices. FIG. 12 is a sectional view after machining of a seat surface and a cavity portion. FIG. 13 is a diagram showing the seat surface having been subjected to finish machining by grinding. FIG. 14 is a diagram showing a state in which a positioning hole is being formed. FIG. 15 is a diagram showing a state in which an aperture A is being formed. FIG. 16 is a diagram showing a state in which an aperture B is being formed. FIG. 17 is a diagram showing a state in which an orifice is being formed. FIG. 18 is a SEM photograph showing a surface condition after press working for apertures A, B and orifice. FIG. 19 is a SEM photograph showing a surface condition of apertures B and orifice after quenching.

A machining process for the orifice plate 15 will be described below with reference to FIGS. 4 to 17.

FIG. 4 shows a series of machining steps for the orifice plate. In these machining steps the orifice plate 15 assumes such shapes as shown in FIGS. 7 to 11.

First, a description will be given about a punch for press working. FIG. 5 shows punches 43 and 44 for aperture machining. To form apertures A and B, cutting blades 43*a* and 44*a* are changed in size. Corners R (43*b*, 44*b*) are formed at the tips of the cutting blades 43*a* and 44*a*, respectively. With the corners R, the plastic fluidity of material is improved and the surface roughnesses of the cutting blades are transferred to the apertures. To this end, the cutting blades are polished to mirror surfaces of Rz 0.2 μm or less in surface roughness, further, they are coated with a ceramic material, e.g., TIN or TICN for improving seizure resistance.

FIG. 6 shows a punch 45 for orifice machining. A cutting blade 45*a* has a tapered portion 45*b* at its tip end face and corners R (45*c*) at its tip corners, a land 45*d* thereof being slightly smaller in diameter than the tip diameter. Since the orifices are smaller in diameter and deeper than the apertures, it is necessary to improve the plastic fluidity of material. Therefore, the tapered portion 45*b* is formed in addition to the corners R (45*c*) and the surface roughness of the cutting blade 45*a* is transferred to the orifices. Further, in order to minimize a frictional surface between a cutting edge side face and an orifice-forming face and thereby prevent worsening of the surface roughness caused by seizure for example, the land 45*d* is formed smaller than the tip diameter to prevent it from being rubbed against the orifice inner surface. Like the aperture machining punch, the cutting blade 45*a* is polished to a mirror surface of Rz 0.2 μm or less in surface roughness and is coated with a ceramic material, e.g., TIN or TICN for improving seizure resistance.

The orifice plate 15 is machined in the following manner. As shown in FIG. 7, a generally disc-like blank 15' having a spherical portion 30 at an approximately central part of its end face is fabricated by cutting or plastic working. At an end face of the blank 15' on the side opposite to the spherical portion 30 is formed a bowl-like recess.

Next, the fuel injecting portions are subjected to press working. In this step, positioning holes 31, apertures A (54*a* to 59*a*), apertures B (54*b* to 59*b*) and orifices 54 to 59 are subjected to press working in a continuous manner while chucking the blank 15'.

As shown in FIG. 14, the blank 15' formed with the spherical portion 30 is installed on an upper surface of a die 41 and its outer periphery is held firmly with a collet chuck 42. Further, an outer periphery side of the spherical portion 30 is urged with a cutting blade 40*a* of a punch 40 while holding the blank 15' and is machined to form a positioning hole 31*a*.

Likewise, positioning holes 31*b* and 31*c* are formed. By thus forming the positioning holes 31*a*, 31*b* and 31*c* in the blank 15' there is obtained such an orifice plate 15 as shown in FIGS. 2 and 8, the orifice plate 15 having the positioning holes 31*a*, 31*b* and 31*c* in three positions on the outer periphery side of the spherical portion 30.

Then, while holding the orifice plate 15 with the collet chuck 42, the spherical portion 30 is urged with the cutting blade 43*a* of the punch 43 to form the aperture 54*a* by extrusion. Likewise, the apertures A (55*a*, 56*a*, 57*a*, 58*a* and 59*a*) are formed. Machining for the apertures A may be press working plus surface work hardening. By thus press working the orifice plate 15, such apertures A as shown in FIG. 9 are formed in the spherical portion 30, the apertures A each having a surface roughness of Rz 0.2 μm or less and having a surface approximately orthogonal to the aperture axis.

Next, as shown in FIG. 16, in a state in which the orifice plate 15 is held by the collet chuck 42, a bottom surface of the aperture A54*a* is urged with the cutting blade 44*a* of the punch 44 in the same direction as the punch 43 which has been used to form the apertures A, to form the aperture B54*b* in the shape of a blind hole by extrusion. Likewise, apertures B (55*b*, 56*b*, 57*b*, 58*b* and 59*b*) are formed. In this case, the order of machining is determined appropriately in accordance with the deflecting direction of each orifice. The machining for the apertures B may be press working plus surface work hardening. By thus forming the apertures B by subjecting the orifice plate 15 to press working there is obtained such an orifice plate 15 as shown in FIG. 10, the orifice plate 15 having apertures B with a surface roughness of Rz 0.2 μm or less formed in the bottoms of the apertures A.

Next, as shown in FIG. 17, in a state in which the orifice plate 15 is held by the collet chuck 42, the cutting blade 45*a* of the punch 45 is urged perpendicularly to the bottom of the aperture B54*b* to form an orifice 54 in the shape of a blind hole by extrusion. Likewise, orifices 55, 56, 57, 58 and 59 are formed. The order of machining is determined appropriately in accordance with the deflecting direction of each orifice. By thus forming orifices in the orifice plate 15 by press working there is obtained such an orifice plate 15 as shown in FIG. 11 which orifice plate has orifices in the bottoms of the apertures B. Since the orifice plate 15 is held by the collet chuck 42 during the machining, the machining is carried out with a high positional accuracy so that the axes of the apertures A, B and the orifices are approximately aligned with one another in relation to the positioning holes. Moreover, since each orifice is formed in the shape of a blind hole by press working, its inner surface can be machined to an entirely machined surface free of any fracture surface and having a surface roughness of Rz 0.2 μm or less.

When press-working the apertures A and B, the material is extruded forward like 15*b*, so that the plate thickness of each orifice-machined portion can be made larger than in the form of a blank and hence it is possible to suppress the occurrence of a fracture surface.

Besides, since the blank can be made thin, a machining stress in orifice machining can be made low and hence it is possible to improve the orifice accuracy and the punch life.

Further, since each orifice-machined portion swells partially (15*b*) as a result of extrusion of each aperture B, the flow of material to an adjacent orifice in orifice machining is lessened and a previously-machined orifice is difficult to deform, thus permitting a high accuracy machining.

Additionally, since each orifice is formed in the shape of a blind hole, its rigidity is high, and when an adjacent orifice is subjected to press working, an already-machined orifice is difficult to deform and hence a highly accurate machining can be achieved (if each orifice is punched, the orifice becomes less rigid and therefore becomes easier to deform when an adjacent hole is formed by punching).

Next, as shown in FIG. 12, a cavity 15*d* and a generally conical seat surface 15*a* (valve seat) are formed. Extruded portions 15*b* which have been formed in the recess of the end face on the side opposite to the spherical portion 30 by forming orifices each in the shape of a blind hole are removed and all the six orifices 54 to 59 become open to the seat surface 15*a* side at a time by machining the cabin 15*d* and the generally conical seat surface 15*a* (valve seat). At this time, the machining is done by cutting or by electric discharge machining. Consequently, orifices can be formed over the entire machining surface by press working.

FIG. 18 is a SEM photograph showing an appearance of fuel injecting portions before quenching. The apertures 54*a*, 54*b* and orifice 54 are all in a specularly machined state and the surface roughness of the inner surface of each fuel injecting portion is Rz 0.2 μm or less.

Next, for improving the abrasion resistance of the seat surface 15*a* which serves as an abutting surface of the movable valve 5, the orifice plate 15 is subjected to quenching to a hardness of HRC 52 to 56 for example in the case of martensitic stainless steel SUS420J2. At this time, the orifice plate 15 undergoes recrystallization by martensitic transformation and the inner surfaces of the apertures A, B and orifices become Rz 2 μm or less in surface roughness.

FIG. 19 is a SEM photograph showing an appearance of fuel injecting portions after quenching. In this photograph, grain boundaries like a mesh pattern can be seen clearly on the surface of the fuel injecting portions. The fuel injecting portions are Rz 2 μm or less in surface roughness when measured using a laser type non-contact microscope. The depth of each grain boundary portion is 1 to 1.5 μm. With a contact type surface roughness measuring instrument, the surface roughness is Rz 0.5 μm or less and it is impossible to measure the grain boundary depth. Thus, the surface roughness differs depending on the measuring method. In the present invention there are used values obtained by a laser type non-contact microscope.

Next, as shown in FIG. 13, the seat surface 15*a* after quenching is subjected to grinding as finish machining to improve roundness and reduce surface roughness and thereby improve oil-tightness between the seat surface and the valve seat portion 11*a*.

Lastly, burrs developed on the upstream side of the orifices are removed by seat surface finish machining to complete the orifice plate. As the method for removing the burrs there may be adopted any of various methods, but it is preferable that the burrs be removed at a time by water jet for example.

By going through the above steps a plurality of orifices and apertures different in deflection angle can be formed easily, less expensively, in good productivity, with a surface roughness of Rz 2 μm or less, and with few variations in shape, accuracy and surface roughness.

Consequently, the adhesion of deposits such as carbon resulting from combustion of fuel in direct injection to the apertures A, B and orifices can be diminished and it is possible to provide a fuel injection valve which retains the performance in its initial state and which is superior in durability.

For example, in a running test with an actual gasoline-fueled vehicle, a fuel injection valve using an orifice plate having one-step apertures formed with orifices (surface roughness Rz 5.5 μm) by electric discharge machining had deposits, etc. adhered to the apertures and orifices after 30,000 km running, resulting in 15% lowering of the flow rate. This was made clear in the above test.

On the other hand, as to the fuel injection valve according to the present invention, since the apertures A, B and orifices are superior in surface roughness to those of the valve machined by electric discharge machining, so that the adhesion of deposits to the apertures A, B and orifices could be diminished and there was no change in the flow rate after 42,000 km running.

Moreover, by forming the positioning holes, apertures A, B and orifices while chucking the blank, the machining can be done with a high positional accuracy in each step without the need of alignment for plural orifices deflected relative to the axis of the injection valve.

The method of forming the orifices by press working according to the present invention, in comparison with the electric discharge machining method for the orifices, can shorten the machining time per orifice to about one-thirtieth, thus making it possible to suppress equipment investment and provide a less expensive orifice plate.

Although the present invention has been described above by way of an embodiment thereof, the present invention is not limited to the above embodiment, but various changes may be made within the scope of the inventive idea of the present invention.

For example, although in the above embodiment a description was given assuming that the apertures A-forming area was the spherical portion 30, the said area may be any other curved surface area (curved surface portion) than the spherical area. Moreover, the apertures A may be omitted and there may be a one-step shape with only apertures B.

DESCRIPTION OF REFERENCE NUMERALS

1 injection valve body
15 orifice plate
15*a* seat surface
30 spherical portion
31 positioning hole
40,43,44 punch
41 die
42 collet chuck
54-59 orifice
54*a*-59*a* aperture A
54*b*-59*b* aperture B

The invention claimed is:

1. A fuel injection valve comprising:

a nozzle, the nozzle having a valve seat for sitting thereon of a valve element;

an orifice formed on a downstream side of a seat portion of the valve seat for contact with the valve element; and an aperture formed on an outlet side of the orifice and connected to the orifice;

wherein the surface roughness of an inner surface of the orifice and that of an inner surface of the aperture are set to Rz 2 μm or less; and wherein the orifice inner surface and the aperture inner surface each have a mesh-like pattern of 1.5 μm or less in depth formed by a grain boundary.

2. A machining method for a nozzle having a valve seat for sitting thereon of a valve element, an orifice formed on a downstream side of a seat portion of the valve seat for contact with the valve element, and an aperture formed on an injection side of the orifice and connected to the orifice, the method comprising the steps of:

forming the aperture in the shape of a blind hole having a plastic-worked surface of a surface roughness of Rz 0.2 μm or less by press working;

forming the orifice in a bottom of the aperture so as to have a plastic-worked surface of Rz 0.2 μm or less in surface roughness by press working; and quenching the nozzle to adjust the surface roughness of an inner surface of the orifice and that of an inner surface of the aperture to Rz 2 μm or less.

3. A machining method according to claim 2, wherein a mesh-like pattern of 1.5 μm or less in depth formed by a grain boundary is formed on the inner surface of the orifice and that of the aperture after the quenching.

4. A machining method according to claim 3, wherein the nozzle is formed of a martensitic stainless steel having a carbon content of 0.25% or more and having a hardness after quenching of HRC 52 or more.

* * * * *